US011795033B2

(12) United States Patent
Kulak et al.

(10) Patent No.: US 11,795,033 B2
(45) Date of Patent: Oct. 24, 2023

(54) ELEVATOR CAR DOOR INTERLOCK

(71) Applicant: Otis Elevator Company, Farmington, CT (US)

(72) Inventors: Richard E. Kulak, Bristol, CT (US); Michael J. Tracey, Cromwell, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/407,899

(22) Filed: Aug. 20, 2021

(65) Prior Publication Data

US 2021/0380373 A1 Dec. 9, 2021

Related U.S. Application Data

(60) Continuation of application No. 16/850,196, filed on Apr. 16, 2020, now Pat. No. 11,124,389, which is a division of application No. 15/749,060, filed as application No. PCT/US2016/045155 on Aug. 2, 2016, now Pat. No. 10,882,720.

(60) Provisional application No. 62/200,910, filed on Aug. 4, 2015.

(51) Int. Cl.

| | |
|---|---|
| ***B66B 13/20*** | (2006.01) |
| ***B66B 13/18*** | (2006.01) |
| ***B66B 13/12*** | (2006.01) |

(52) U.S. Cl.

CPC ..... *B66B 13/20* (2013.01); *B66B 13/12* (2013.01); *B66B 13/18* (2013.01)

(58) Field of Classification Search

CPC ..... B66B 13/20; B66B 13/12; B66B 13/18
See application file for complete search history.

(56) References Cited

U.S. PATENT DOCUMENTS 3,556,257 A * 1/1971 Caputo ..... B66B 13/143 187/319
4,313,525 A * 2/1982 McDonald ..... B66B 13/20 187/314
4,423,799 A * 1/1984 Glaser ..... B66B 13/20 187/314

(Continued)

FOREIGN PATENT DOCUMENTS

CN 101132983 A 2/2008
CN 101663224 A 3/2010

(Continued)

OTHER PUBLICATIONS

Chinese Office Action; International Application No. 201680045507.6; International Filing Date: Feb. 2, 2018; dated Jun. 25, 2019; 7 pages.

(Continued)

*Primary Examiner* — Michael A Riegelman
(74) *Attorney, Agent, or Firm* — CANTOR COLBURN LLP

(57) ABSTRACT

A method of unlocking an elevator car door or an elevator car includes operating a door operator and moving a movable vane operably coupled to the door operator. If the elevator car is positioned within a landing door zone, the movable vane is moved into contact with an interlock roller. An engagement latch is rotated to disengage from an electrical contact in response to moving the movable vane into contact with the interlock roller.

9 Claims, 12 Drawing Sheets

(56) References Cited

U.S. PATENT DOCUMENTS 4,491,200 A * 1/1985 Thompson ..... B66B 13/12 187/314
4,529,065 A * 7/1985 Kraft ..... B66B 13/08 187/314
4,926,974 A * 5/1990 Morris ..... B66B 13/12 187/314
4,947,964 A * 8/1990 Husmann ..... B66B 13/12 187/314
5,105,916 A * 4/1992 Steacy ..... B66B 13/12 187/319
5,139,112 A * 8/1992 Tonna ..... B66B 13/16 187/331
5,538,106 A * 7/1996 McHugh ..... B66B 13/12 49/120
5,651,427 A * 7/1997 Kulak ..... B66B 13/12 49/120
5,651,428 A * 7/1997 Ahigian ..... B66B 13/12 49/122
5,732,796 A * 3/1998 Ahigian ..... B66B 13/12 187/314
5,819,877 A * 10/1998 Rivera ..... B66B 13/20 187/314
5,899,302 A * 5/1999 O'Donnell ..... B66B 13/20 187/314
5,918,706 A * 7/1999 Kowalczyk ..... B66B 13/20 187/334
5,988,320 A * 11/1999 Mittermayr ..... B66B 13/12 187/319
6,021,871 A * 2/2000 Grabner ..... B66B 13/16 187/335
6,062,345 A * 5/2000 Olofsson ..... B66B 13/185 187/319
6,164,417 A * 12/2000 Oberleitner ..... B66B 13/12 187/335
6,173,815 B1 * 1/2001 Mittermayr ..... B66B 13/12 187/319
6,189,658 B1 * 2/2001 Karner ..... B66B 13/12 187/319
6,446,759 B1 * 9/2002 Kulak ..... B66B 13/12 187/331
7,077,242 B2 * 7/2006 Cocher ..... B66B 13/20 187/333
7,097,002 B2 * 8/2006 Bisang ..... B66B 13/12 187/335
7,100,745 B2 * 9/2006 Bisang ..... B66B 13/12 187/335
7,252,179 B2 * 8/2007 Oberleitner ..... B66B 13/12 187/335
7,255,203 B2 * 8/2007 Rennetaud ..... B66B 13/12 187/334
7,350,623 B2 * 4/2008 Kinoshita ..... B66B 13/20 187/319
7,370,731 B2 5/2008 Cocher
7,413,058 B2 * 8/2008 Zappa ..... B66B 13/20 187/331
7,607,517 B2 * 10/2009 Karner ..... B66B 13/12 187/319
7,681,695 B2 * 3/2010 Christen ..... B66B 13/12 187/334
7,886,877 B2 * 2/2011 Ueda ..... B66B 13/20 187/316
9,637,350 B2 * 5/2017 Mittermayr ..... B66B 13/12
10,526,172 B2 * 1/2020 Meguro ..... B66B 13/16
10,710,843 B2 * 7/2020 Kulak ..... B66B 13/12
2007/0205059 A1 * 9/2007 Badaoui ..... B66B 13/12 187/324
2008/0271958 A1 * 11/2008 Lelic ..... B66B 13/185 187/319
2010/0059318 A1 * 3/2010 Ueda ..... B66B 13/14 187/316
2012/0298453 A1 * 11/2012 Fujii ..... B66B 13/12 187/330
2013/0048433 A1 * 2/2013 Tantis ..... B66B 13/12 187/319
2015/0014101 A1 * 1/2015 Tracey ..... B66B 13/08 187/324
2016/0130116 A1 * 5/2016 Kitazawa ..... B66B 13/18 187/335
2018/0118514 A1 * 5/2018 Bruno ..... B66B 1/3461
2018/0229972 A1 * 8/2018 Kulak ..... B66B 13/16
2018/0265334 A1 * 9/2018 Kulak ..... B66B 13/12
2019/0337767 A1 * 11/2019 Tracey ..... B66B 13/20
2019/0337768 A1 * 11/2019 Kulak ..... B66B 13/12
2019/0337769 A1 * 11/2019 Khzouz ..... B66B 13/30
2020/0039794 A1 * 2/2020 Kim ..... B66B 13/08
2020/0055705 A1 * 2/2020 Tracey ..... B66B 13/12
2020/0122978 A1 * 4/2020 Tracey ..... B66B 13/12
2020/0262683 A1 * 8/2020 Kulak ..... B66B 13/18

FOREIGN PATENT DOCUMENTS

CN 101983170 A 3/2011
CN 102015510 A 4/2011
CN 102414113 A 4/2012
CN 203173665 U 9/2013
CN 103562116 A 2/2014
CN 104203795 A 12/2014
CN 204508485 U 7/2015
DE 112012006072 T5 12/2014
EP 0709334 A1 5/1996
EP 1266860 A1 12/2002
EP 1621511 A2 2/2006
EP 1841682 A1 10/2007
EP 1980521 A1 10/2008
EP 2287103 B1 9/2015
GB 2112352 A 7/1983
JP H08208161 A 8/1996
JP H1022791 A 1/1998
JP 5479567 B1 4/2014
WO 2005077808 A2 8/2005
WO 2005123562 A1 12/2005
WO 2006097997 A1 9/2006
WO 2007088632 A1 6/2009
WO 2009128155 A1 10/2009
WO 2009153845 A1 12/2009
WO 2013140575 A1 9/2013
WO 2014122358 A1 8/2014
WO 2015008386 A1 1/2015
WO 2015041772 A1 3/2015

OTHER PUBLICATIONS

Chinese Office Action; International Application No. 201680045507.6; International Filing Date: Feb. 2, 2018; dated Mar. 11, 2020; 6 pages.
Japanese Office Action; International Application No. 2018-505607; International Filing Date: Feb. 2, 2018; dated Sep. 17, 2020; 6 pages.
Notice of Allowance; U.S. Appl. No. 15/749,060, filed Jan. 30, 2018; dated Jan. 28, 2020; 20 pages.
PCT Notification of Transmittal of The International Search Report; International Application No. PCT/US2016/045155; International Filing Date: Aug. 2, 2016, dated Nov. 15, 2016; pp. 1-6.
PCT Written Opinion; International Application No. PCT/US2016/045155; International Filing Date: Aug. 2, 2016, dated Nov. 15, 2016; pp. 1-6.
U.S. Non-Final Office Action; U.S. Appl. No. 15/749,060, filed Jan. 30, 2018; dated May 18, 2020; 18 pages.
Korean Office Action for Korean Application No. 10-2018-7005612; Report dated Feb. 3, 2023 (pp. 1-6).

* cited by examiner

ELEVATOR CAR DOOR INTERLOCK

CROSS-REFERENCE TO RELATED APPLICATIONS

This application is a continuation of U.S. application Ser. No. 16/850,196 filed Apr. 16, 2020, which is a division of U.S. application Ser. No. 15/749,060 filed Jan. 30, 2018, which is a National Stage application of PCT/US2016/045155 filed Aug. 2, 2016, which claims the benefit of U.S. Provisional Application Ser. No. 62/200,910, filed Aug. 4, 2015, all of which are incorporated herein by reference in their entirety.

BACKGROUND

The present disclosure relates to an elevator system, and more specifically to a method and means for engaging elevator car and landing doors.

In a typical elevator or lift installation, the vertically moving elevator car is positioned so as to align its entrance with corresponding openings at a plurality of landings in a multi-floor building. Modern installations typically have one or more horizontally sliding doors disposed on the elevator car and at least one sliding door disposed on each of the landing floors, all of which remain closed during movement of the elevator car within a hoistway.

Upon arrival of the elevator car at a floor or landing, a door opening mechanism is activated which drives the elevator car doors horizontally for permitting access to the elevator car. In typical installations, one or more vanes projecting from the surface of the elevator car door in the direction of the adjacent landing door engage various structures, for example vanes, rollers, or other protrusions projecting from the landing door, to drive the landing door horizontally, thereby permitting passengers to traverse between the car and landing.

Elevator codes require that the elevator landing doors remain fastened securely against unauthorized entry unless an elevator car is positioned directly adjacent the landing. Likewise, in certain countries, the elevator car must remain latched against manual movement unless the car is positioned so as to register with a landing. Various mechanisms and systems have been proposed in the prior art to secure and unsecure landing and elevator car doors as the elevator car traverses the elevator hoistway. Various mechanical and electrical interlock systems used to date have the disadvantage of being complex and subject to malfunction and/or frequent service requirements. Existing interlock systems are typically actuated by solenoids or are mechanically linked to the door coupler. These electrical systems have start delays and require a battery backup in the event of a loss of power. Mechanical systems are often noisy and require a complex set of linkages, cams, and springs to function.

SUMMARY

According to an embodiment, an elevator car door interlock for unlocking an elevator car door of an elevator car is provided including a lock member including an electrical contact. A rotatable link arm has a sensing mechanism configured to detect a position of the elevator car door. An engagement latch is pivotally mounted to the rotatable link arm. The engagement latch is engaged with the electrical contact when the elevator car door is locked. The engagement latch is rotated out of engagement with the electrical contact when the elevator car door is unlocked.

In addition to one or more of the features described above, or as an alternative, in further embodiments a bumper is configured to limit rotation of the engagement latch relative to the link arm.

In addition to one or more of the features described above, or as an alternative, in further embodiments the engagement latch is only configured to rotate out of engagement with the electrical contact when further rotation of the link arm is restricted.

In addition to one or more of the features described above, or as an alternative, in further embodiments the sensing mechanism is configured to contact an adjacent vane when the elevator car is in a landing door zone. The contact between the sensing mechanism and the vane is configured to restrict further rotation of the link arm.

In addition to one or more of the features described above, or as an alternative, in further embodiments the vane is mounted to a landing door.

In addition to one or more of the features described above, or as an alternative, in further embodiments a movable vane driven by the link arm is configured to contact an interlock roller when the elevator car is in a landing door zone. The contact between the vane and the interlock roller is configured to restrict further rotation of the link arm.

In addition to one or more of the features described above, or as an alternative, in further embodiments the movable vane is mounted to the elevator car.

In addition to one or more of the features described above, or as an alternative, in further embodiments contact between the sensing mechanism of the link arm and the vane is configured to drive movement of the vane.

In addition to one or more of the features described above, or as an alternative, in further embodiments the sensing mechanism is a sensing roller.

In addition to one or more of the features described above, or as an alternative, in further embodiments the link arm is operably coupled to a door operator such that operation of the door operator causes the link arm to rotate about a pivot.

In addition to one or more of the features described above, or as an alternative, in further embodiments the link arm is connected to a drive belt of the door operator.

According to another embodiment, a method of unlocking an elevator car door or an elevator car is provided including operating a door operator. A link arm of a car door interlock operably coupled to the door operator is rotated. If the elevator car is positioned within a landing door zone, an engagement link coupled to the link arm is configured to pivot relative to the link arm to disengage from an electrical contact. If the elevator car is not positioned within a landing door zone, the engagement link does not pivot relative to the link arm and remains engaged with the electrical contact.

In addition to one or more of the features described above, or as an alternative, in further embodiments the engagement latch is only configured to rotate out of engagement with the electrical contact when further rotation of the link arm is restricted.

In addition to one or more of the features described above, or as an alternative, in further embodiments further rotation of the link arm is restricted when a sensing mechanism coupled to the link arm contacts a landing door vane.

In addition to one or more of the features described above, or as an alternative, in further embodiments further rotation of the link arm is restricted when a movable vane operably coupled to the link arm contacts an interlock roller.

In addition to one or more of the features described above, or as an alternative, in further embodiments movement of the movable vane is driven by contact with a portion of the link arm.

BRIEF DESCRIPTION OF THE DRAWINGS

The foregoing and other features and advantages of embodiments are apparent from the following detailed description, taken in conjunction with the accompanying drawings, in which.

The detailed description of the disclosure describes exemplary embodiments of the present disclosure, together with some of the advantages and features thereof, by way of example with reference to the drawings.

DETAILED DESCRIPTION

Figure 1:
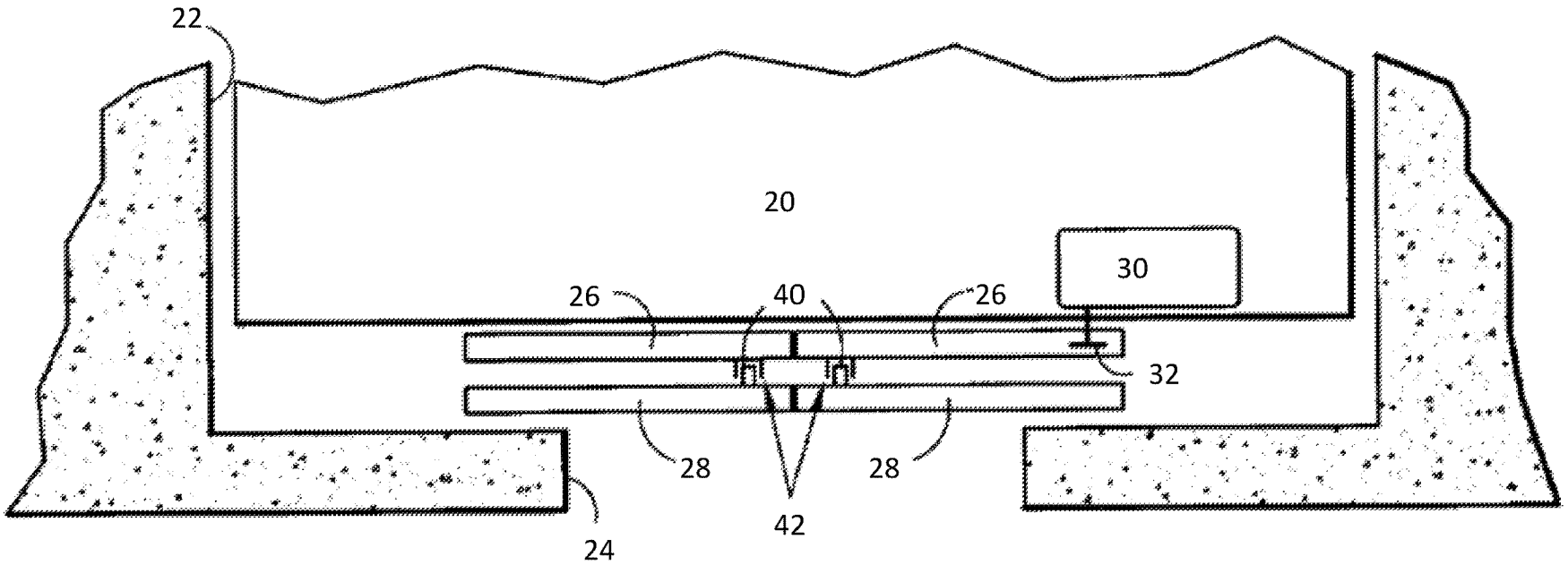
FIG. 1 is a plan view of an elevator car in a hoistway where the elevator car doors and the landing doors are in a closed position.
Figure 2:
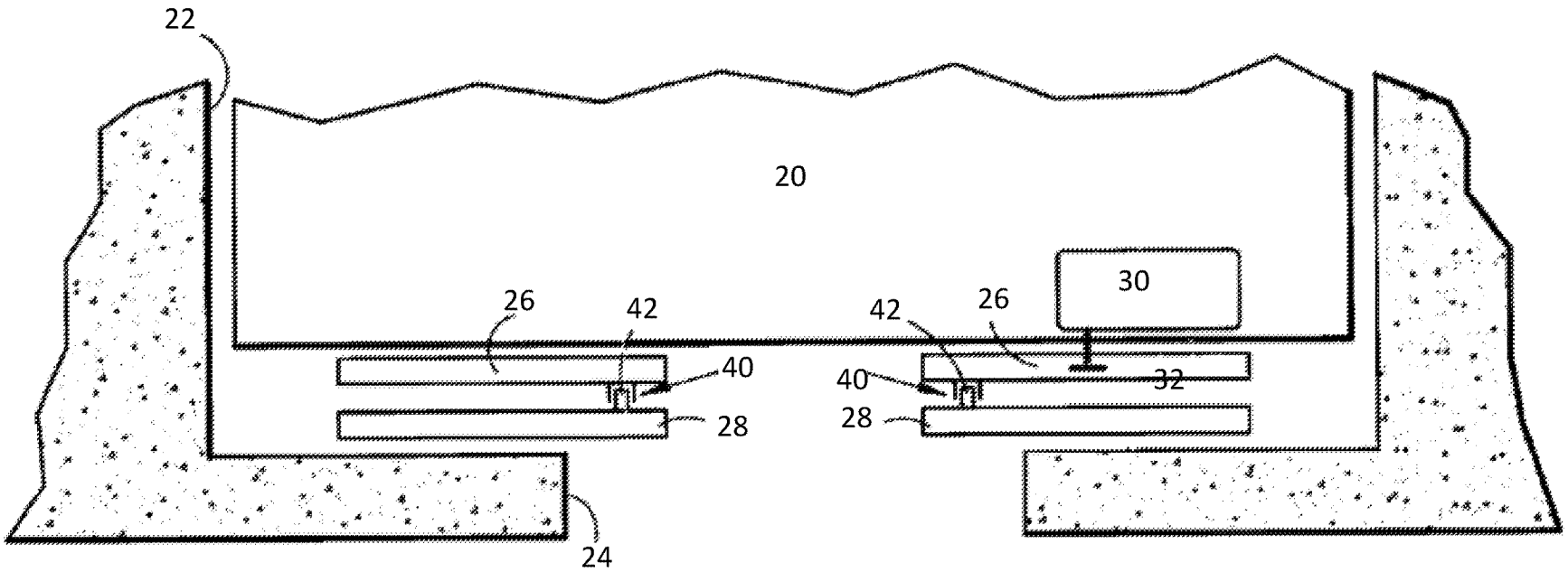
FIG. 2 is a plan view of an elevator car in a hoist where the elevator car doors and the landing doors in a partially opened position.
Figure 3:
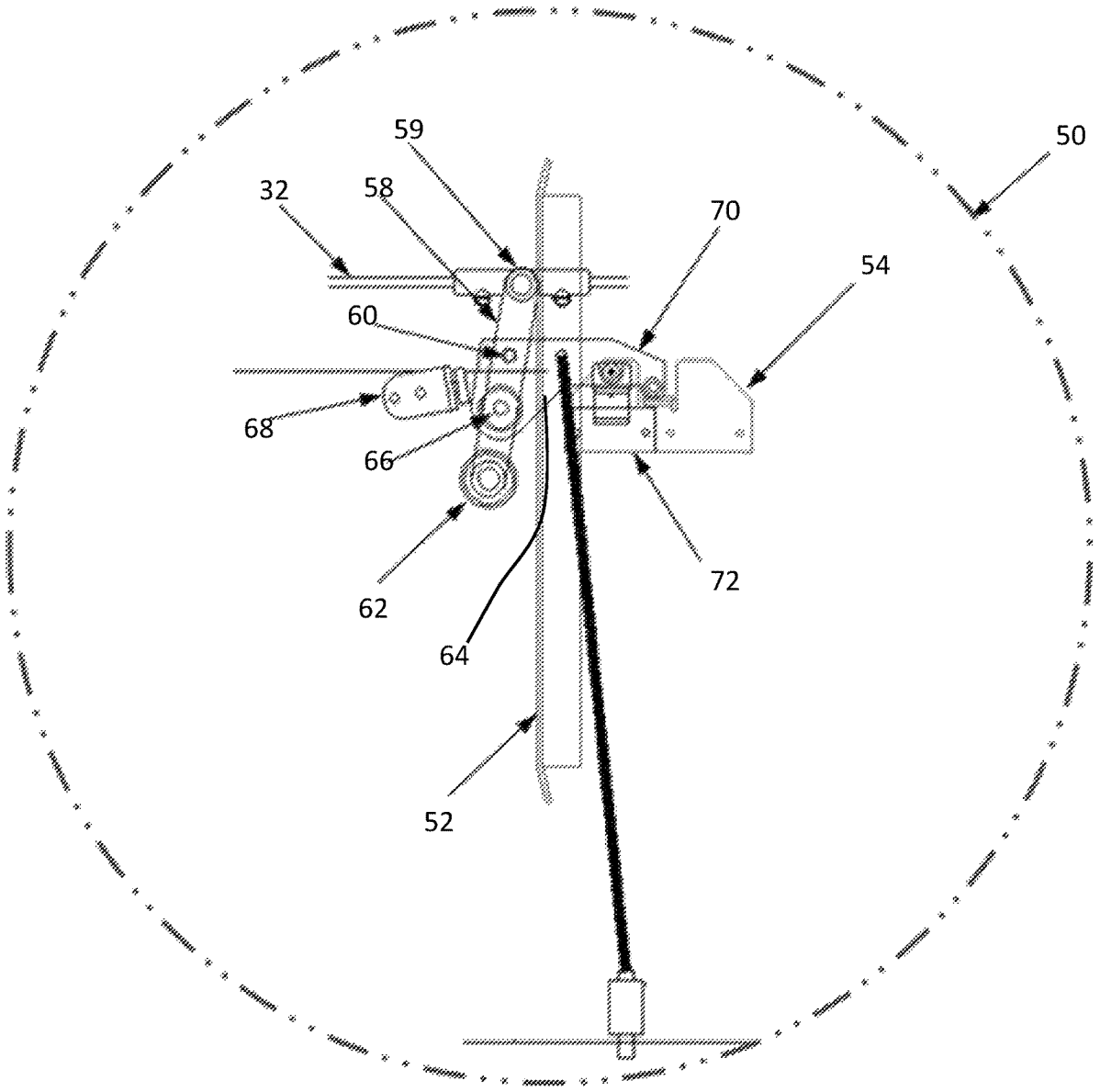
FIG. 3 is a detailed front view of a car door interlock device according to an embodiment.

Referring now to the FIGS. 1 and 2, a typical elevator installation in which a coupling according to the present disclosure may be used is illustrated. FIG. 1 shows a plan view of an elevator car 20 disposed in a vertical hoistway 22 and positioned so as to correspond to a landing 24 having an opening. Elevator car doors 26, are shown in correspondence with laterally sliding landing doors 28. As is typical in such installations, the elevator car doors 26 are actuated by a door operator 30, shown disposed atop the elevator car 20 and having a drive belt 32, or other drive mechanism. FIG. 2 shows the arrangement of FIG. 1 wherein the elevator doors 26 and the landing doors 28 are in a partially opened condition.

A door coupler 40 disposed on the elevator doors 26 is shown engaged with a corresponding protrusion 42 which extends inwardly from the landing doors 28. The protrusions 42 may be any sort of raised boss, bumper, rod, or roller, configured to provide a simple and effective means for enabling the elevator door couplers 40 to engage and move the landing doors 28. As will be appreciated by those skilled in the art, it is desirable that the door coupler 40 firmly grip the landing door protrusion 42 when the elevator and landing doors 26, 28 are operated. In addition, it is also desirable that the coupler 40 completely release said protrusions 42 and maintain sufficient running clearance as the elevator car 20 moves vertically through the hoistway 22.

The door coupler 40 is configured to operate only once it has been determined that the elevator car 20 is positioned within a landing door zone, adjacent at least one landing door 28. In one embodiment, a car door interlock 50 is used to determine whether the elevator car 20 is appropriately positioned within a landing door zone, Δn example of a car door interlock 50 is illustrated in FIGS. 3-8. As shown, a sensing vane 52 is configured to identify the landing door zone. In the illustrated, non-limiting embodiment, the sensing vane 52 is a fixed vane mounted to a landing door 28. The car door interlock 50 includes a lock member 54 mounted to a ground component, such as the car door header or hanger 56 for example. The lock member 54 is configured to lock an upper portion of the elevator car doors 26.

A link arm 58 is coupled, such as at a first end 59 for example, to the drive mechanism 32 of the door operator 30. As the door operator 30 moves the drive mechanism 32, the drive mechanism 32 is configured to rotate the link arm 58 about a pivot pin 60. A sensing roller 62 is coupled to a portion of the link arm 58, for example the second end thereof. In addition, an engagement latch 64 is pivotally connected to the link arm 58 and to the car door hanger 56 at pin 66. A bumper 68 is positioned generally adjacent the link arm 58 and a portion of the engagement latch 64. The bumper 68 is configured to limit rotation of the engagement latch 64 about the pivot pin 66.

When the elevator car doors 26 are in a closed position, the engagement latch 64 is oriented generally horizontally such that an engagement hook 70 located at an end of the engagement latch 64 is arranged in contact with an electrical switch 72 of the lock mechanism 54. This contact sends a signal to the safety chain of the elevator system confirming that the elevator car doors 26 are closed.

Figure 4:
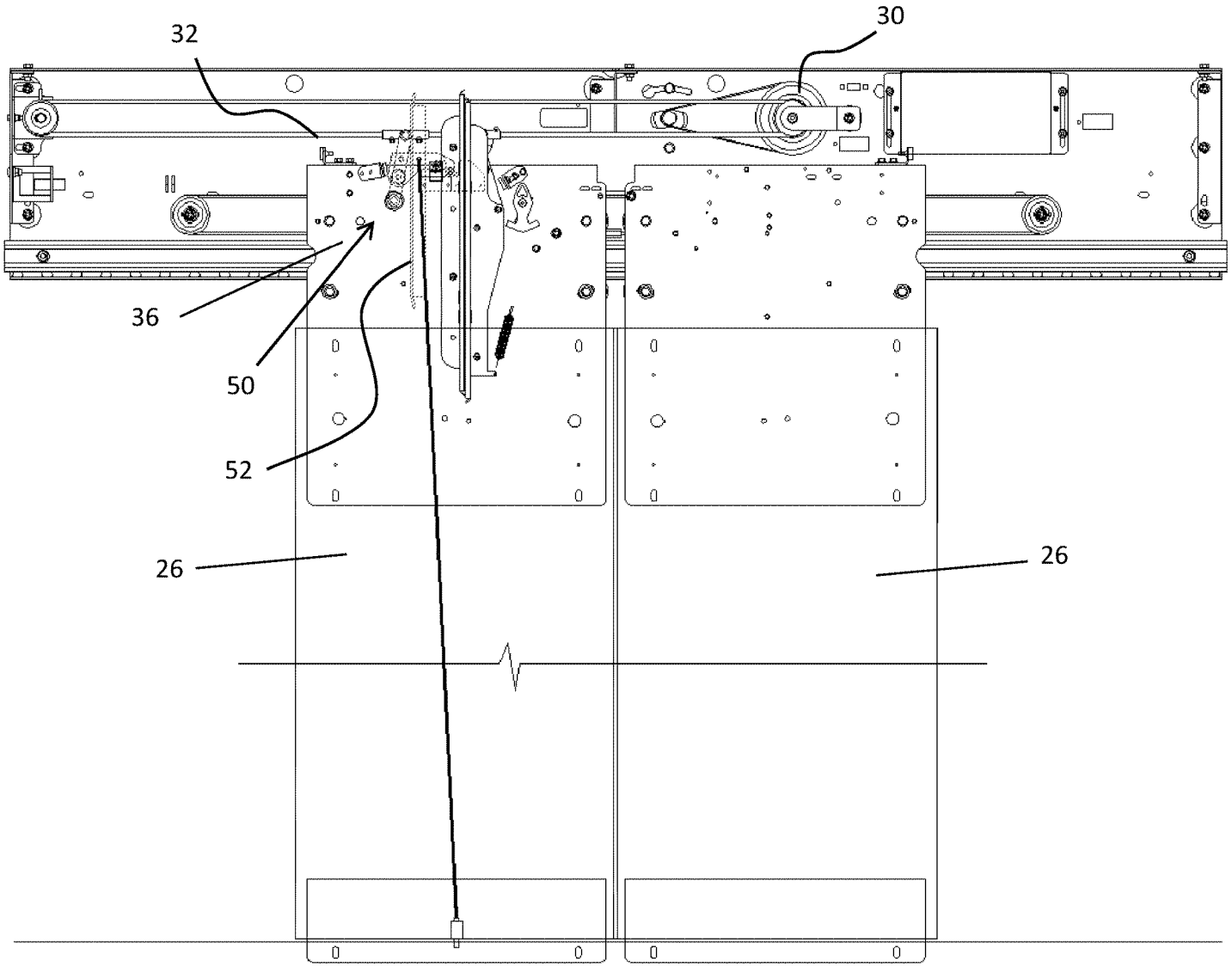
FIG. 4 is a front view of elevator car doors and the car door interlock when the elevator car is within a landing door zone according to an embodiment.
Figure 5:
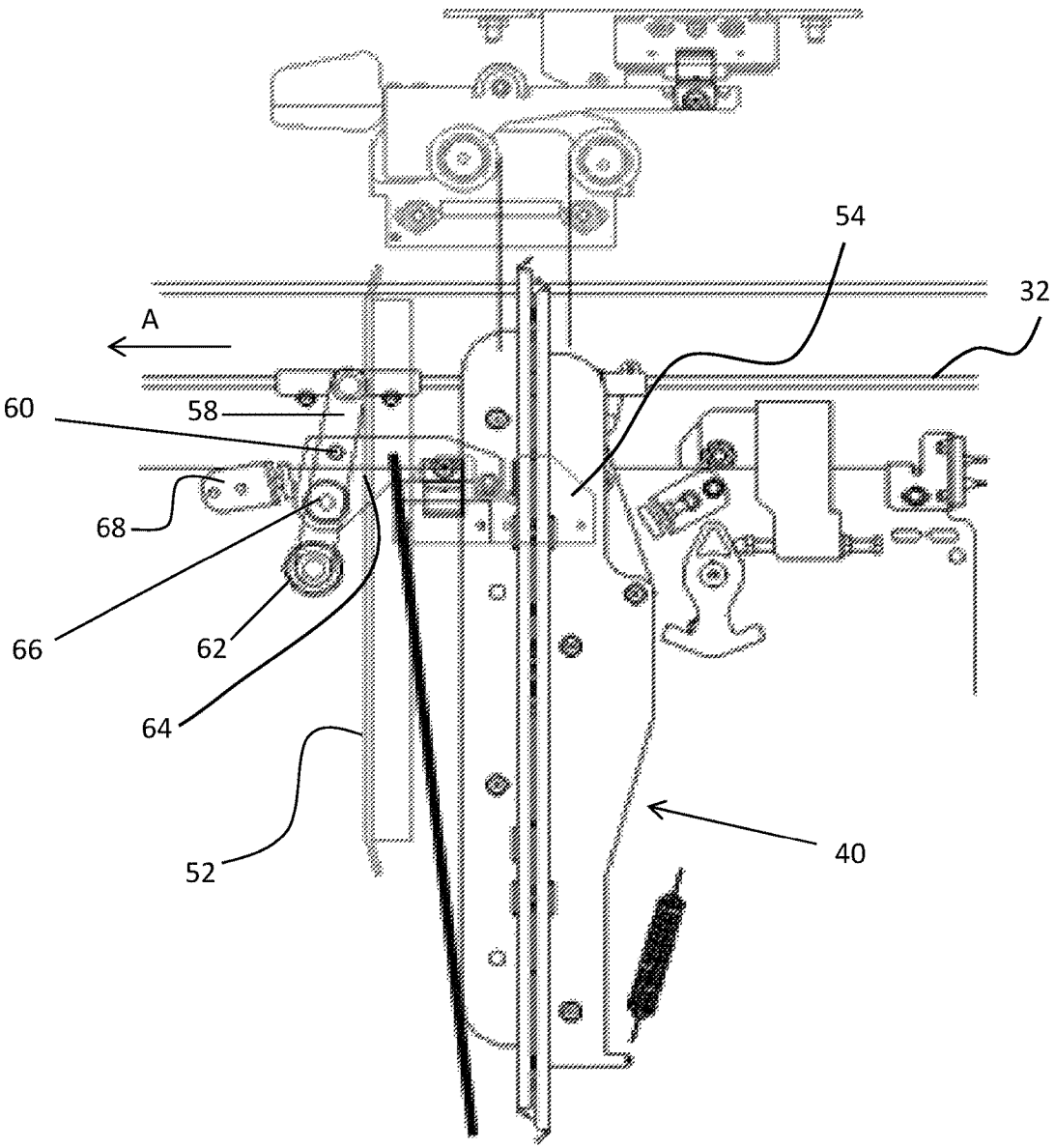
FIG. 5 is a detailed view of the car door interlock of FIG. 4 according to an embodiment.
Figure 6:
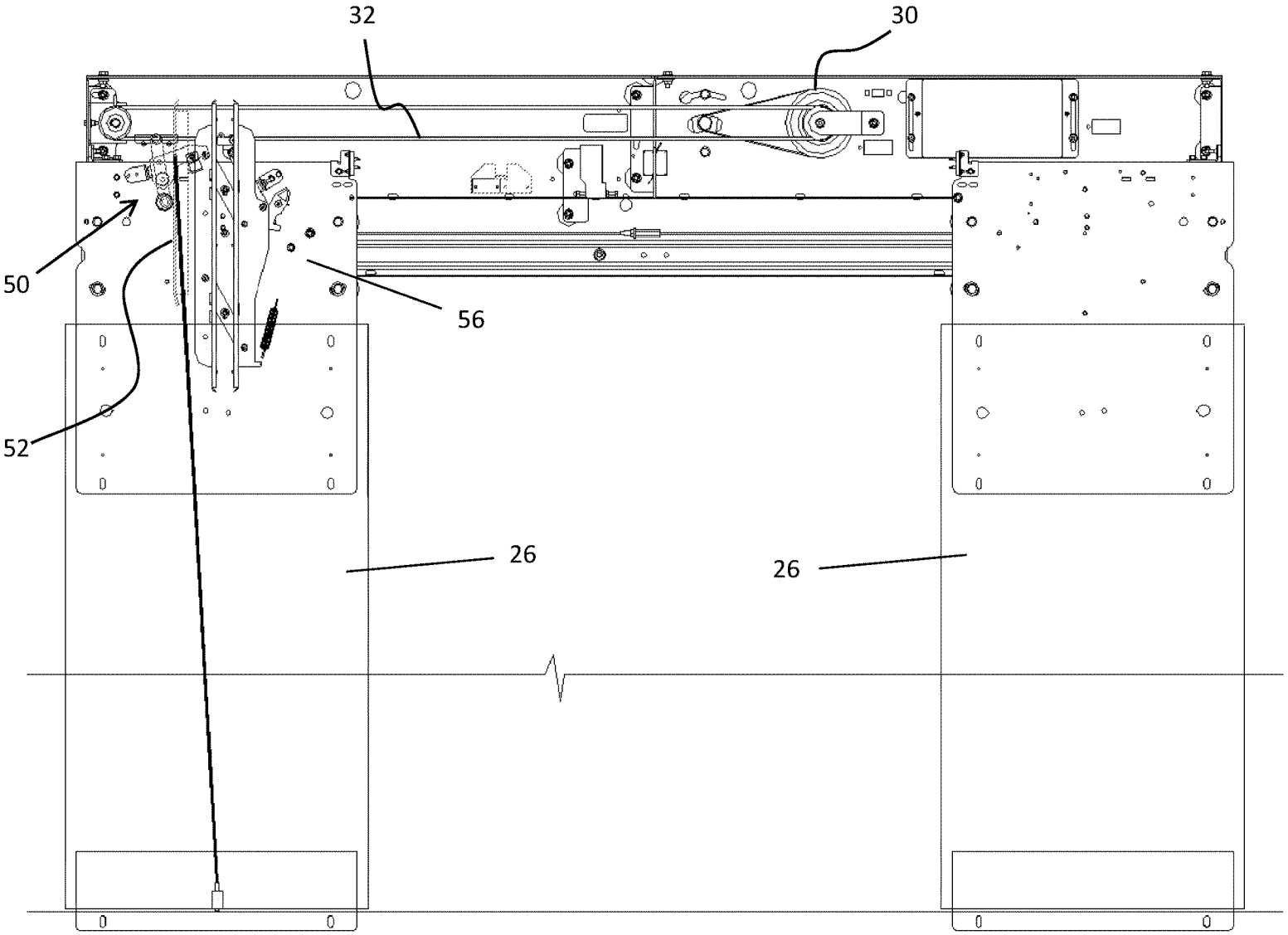
FIG. 6 is a front view of the car door interlock when the elevator car doors and landing doors are coupled and in an open position according to an embodiment.
Figure 7:
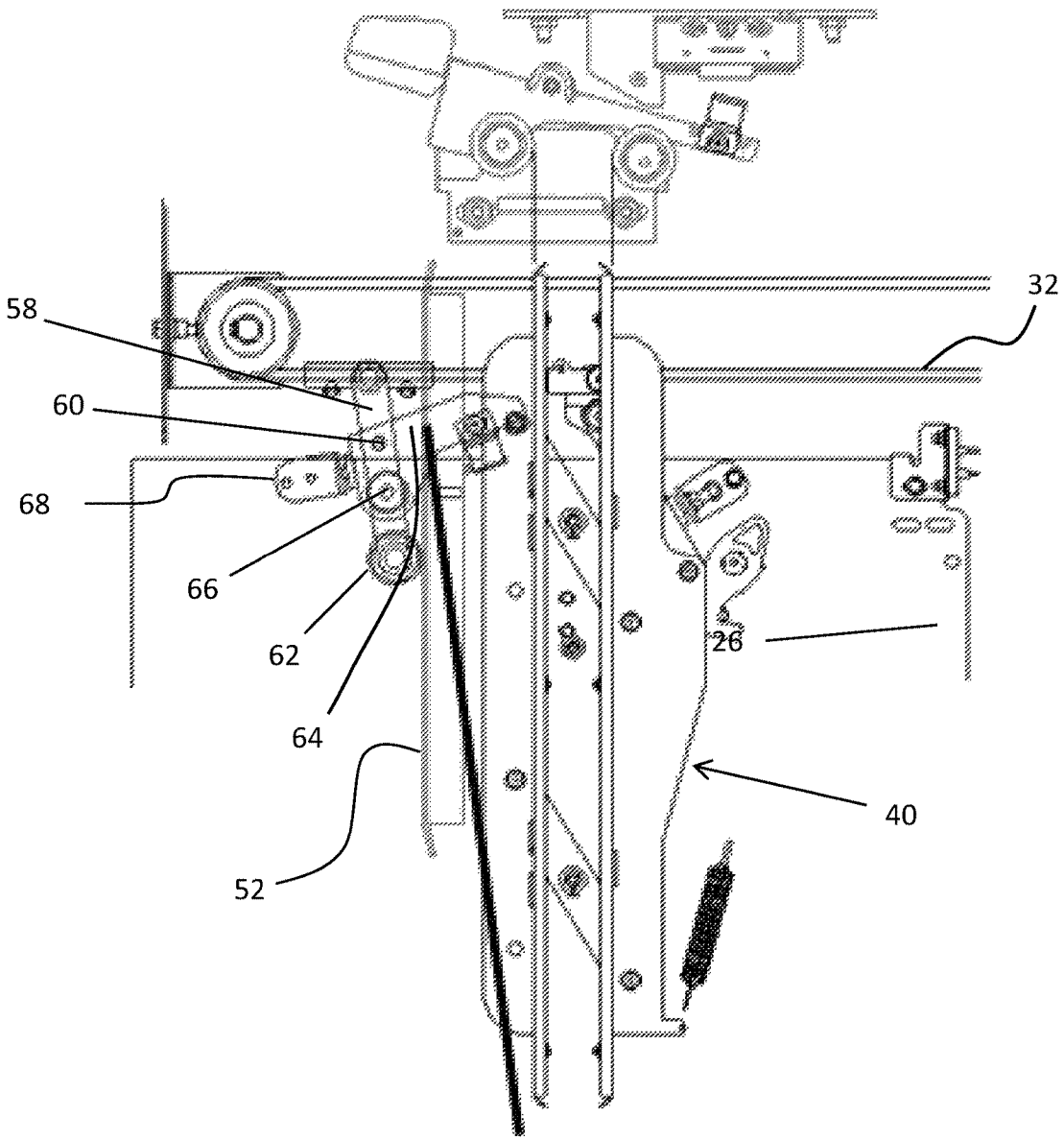
FIG. 7 is a detailed view of the car door interlock of FIG. 6 according to an embodiment.

The elevator car doors 26 are closed in FIGS. 4 and 5. As the elevator car 20 enters a door landing zone, the door operator 30 actuates the drive mechanism 32 in a first direction, indicated by arrow A, causing the link arm 58 to pivot about pin 60, such as in a counterclockwise direction for example. This movement of the link arm 58 causes the sensing roller 62 disposed near an end of the link arm 58 to rotate into contact with the sensing vane 52. Upon detection of the presence of the sensing vane 52, further operation of the drive mechanism 32 in the first direction causes the engagement latch 64 to pivot about pin 66 until the engagement latch 64 contacts the bumper 68 (see FIG. 7). Rotation of the engagement latch 64 about the pivot pin 66 separates the engagement hook 70 from the electrical switch 72, thereby generating a signal that the elevator car doors 26 are unlocked. In this position, the car doors 26 and landing doors 28 are coupled and are able to translate to a fully open position, as shown in FIG. 6.

To close the elevator car doors 26, the door operator 30 actuates the drive mechanism 32 in a second, opposite direction, causing the link arm 58 to pivot about pin 60 and the engagement mechanism to rotate about pin 66 such that the engagement hook 70 rotates into contact with the electrical switch 72. The link arm 58 further rotates to move the roller 62 away from the sensing vane 52. In this position, the elevator car 20 is free to move throughout the hoistway 22 without interference between any of the plurality of sensing vanes 52 located at the various landings 24 and the car door interlock 50.

Figure 8:
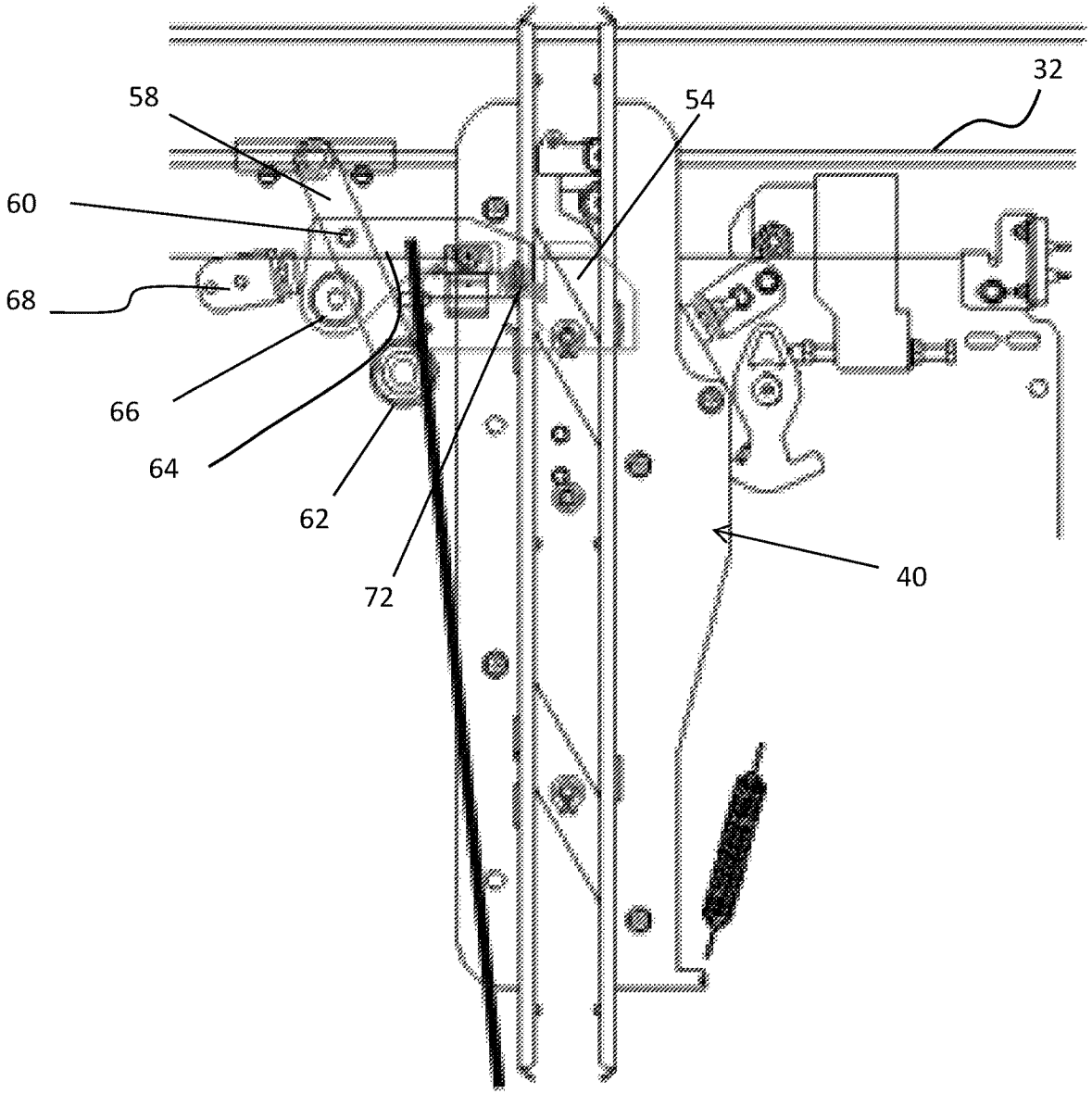
FIG. 8 is a detailed view of the car door interlock when the door operator is energized when the elevator is outside a landing door zone according to an embodiment.

Referring now to FIG. 8, if the door operator 30 actuates the drive mechanism 32 when the elevator car 20 is not within a landing door zone, for example if power to the car door operator 30 is lost, the elevator car doors 26 will not open. In the absence of the sensing vane 52, operation of the door operator 30 causes the link arm 58 to rotate freely about the pivot pin 60. Without the contact between the sensing roller 62 and the sensing vane 52, the link arm 58 rotates relative to the engagement latch 64. The engagement latch 64 does not rotate about pivot 66. As a result, the engagement hook 70 remains in contact with the electrical switch 72 and the car doors 26 remain locked. The car door interlock 50 illustrated and described herein is intended as an example only and other door devices configured to detect the position of the elevator car 20 within the hoistway 22 are within the scope of the disclosure.

Figure 9:
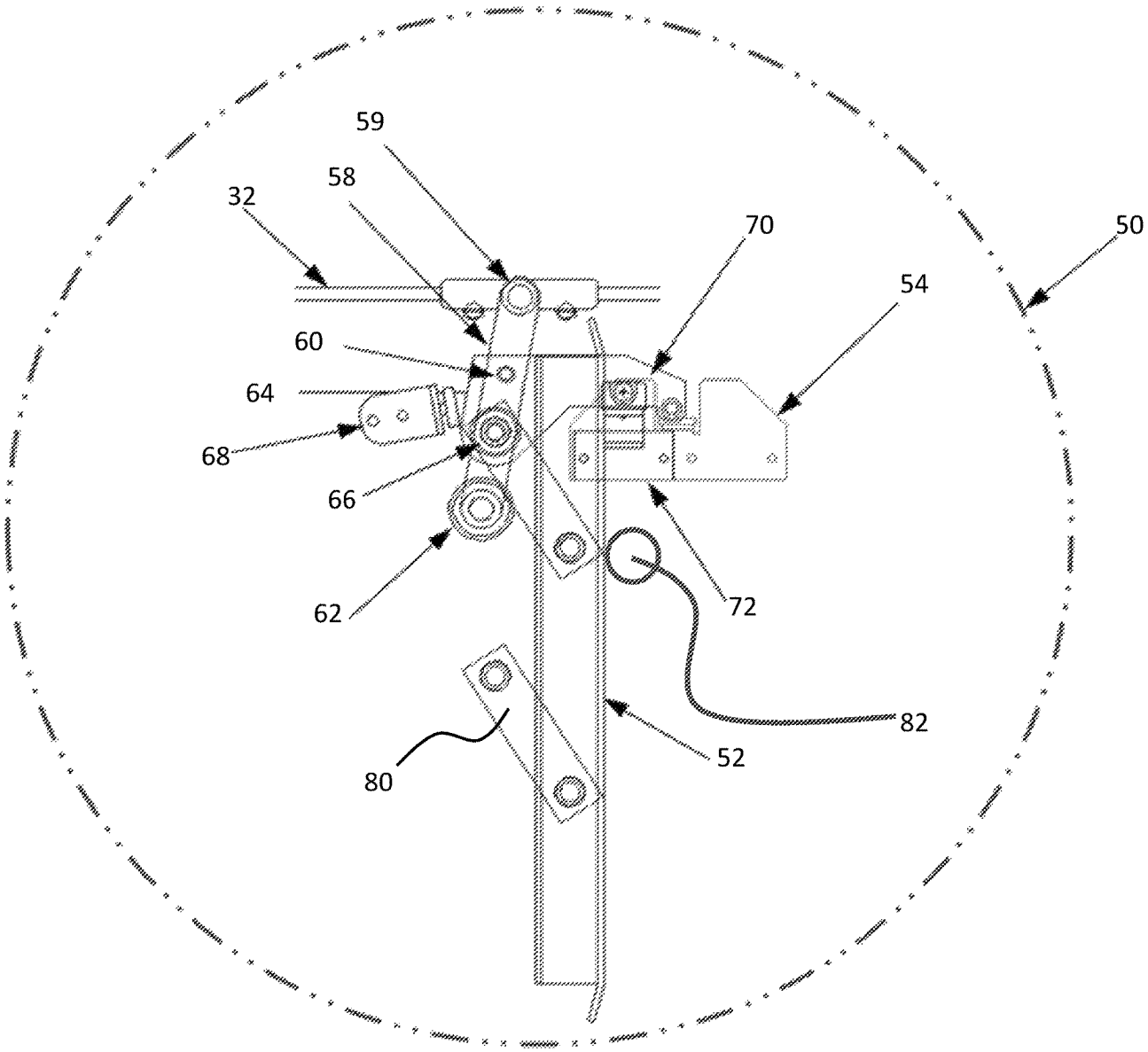
FIG. 9 is a side view of a car door interlock device according to another embodiment.
Figure 10:
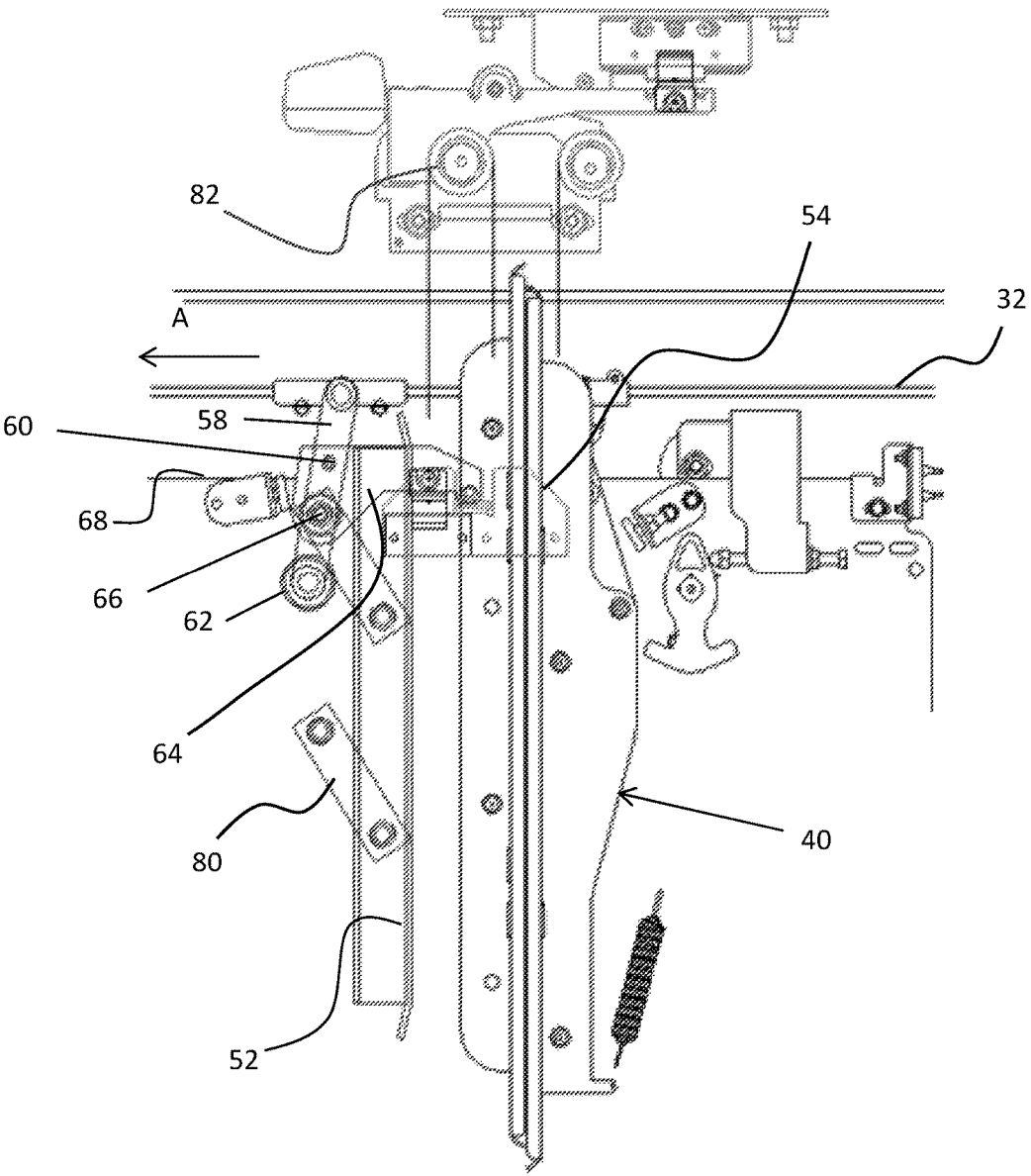
FIG. 10 is a detailed view of elevator car doors and the car door interlock of FIG. 9 when the elevator car is within a landing door zone according to an embodiment.
Figure 11:
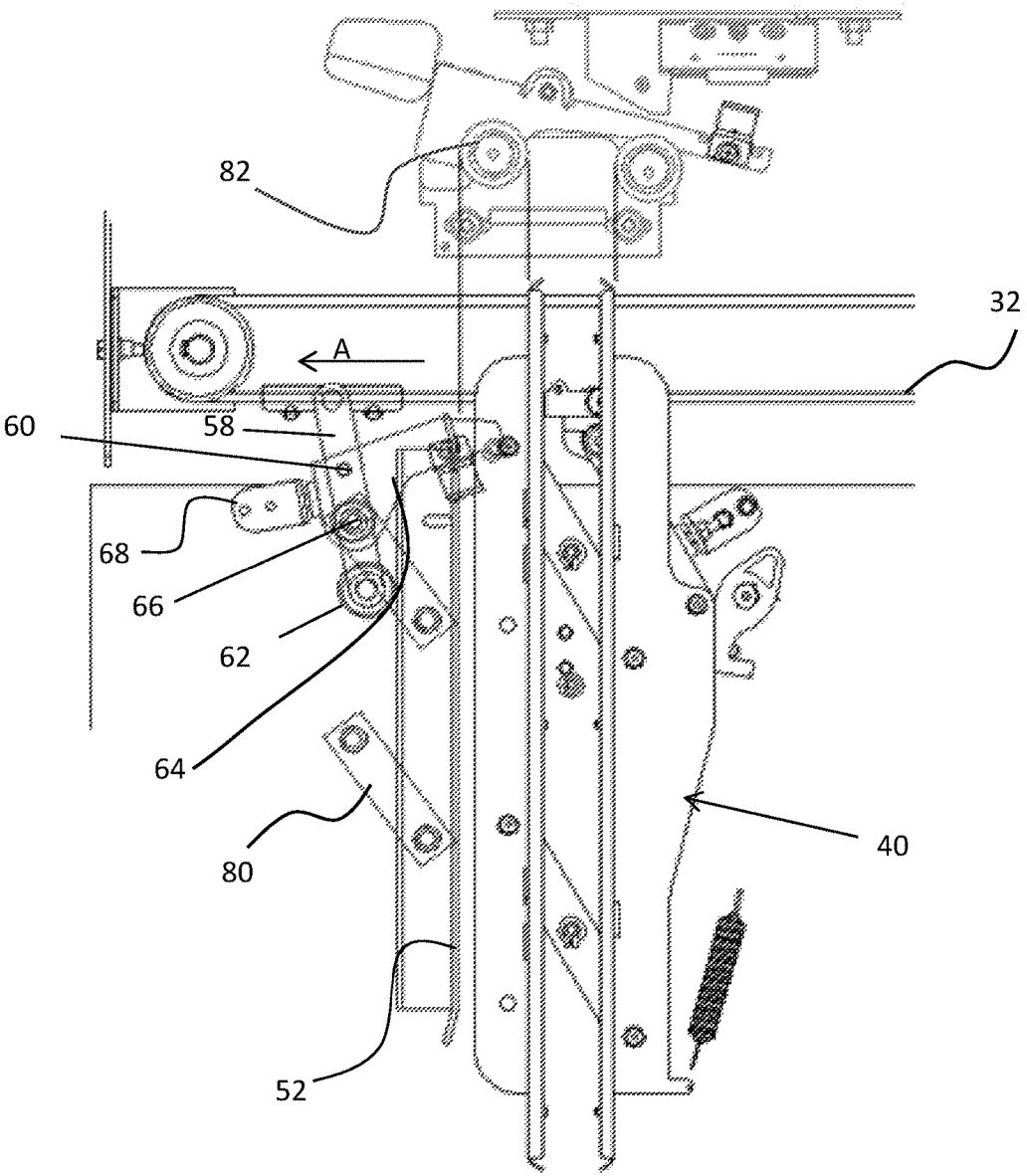
FIG. 11 is a detailed view of the car door interlock of FIG. 9 when the elevator car doors and landing doors are coupled and in an open position according to an embodiment.

Another embodiment of the car door interlock 50 is illustrated in FIGS. 9-11, In the illustrated, non-limiting embodiment, the sensing vane 52 is connected to a portion of the elevator car 20, such as the elevator car door hanger 56 for example, and is configured to move between a first position (FIG. 9) and a second position (FIG. 10). One or more links 80 may be used to pivotally mount the sensing vane 52 to the car door hanger 56.

The principle of operation is substantially similar to the car door interlock 50 of FIGS. 3-8. With reference to FIG. 10, as the elevator car 20 with closed and locked car doors 26 enters a door landing zone, the door operator 30 actuates the drive mechanism 32 in a first direction, indicated by arrow A, causing the link arm 58 to pivot about pin 60. This movement of the link arm 58 causes the sensing roller 62 to rotate into contact with the sensing vane 52. The force applied to the sensing vane 52 via the sensing, roller 62 causes the sensing vane 52 to pivot relative to the car door hanger 56 (FIG. 11).

When the elevator car 20 is positioned within a landing door zone, the sensing vane 52 moves into engagement with an interlock roller 82. For clarity, the interlock roller 82 is illustrated in the FIGS. as being mounted adjacent the landing doors 28 at a position above the door coupler 40; however, the interlock roller 82 is actually located adjacent the door coupler 40 and the drive mechanism 32, and would be in contact with a portion of the rotated sensing vane 52 illustrated in FIG. 11. The contact between the sensing vane 52 and the interlock roller 82, limits further rotation of the sensing vane 52, and therefore the link mechanism 58. As a result, further operation of the drive mechanism 32 in the first direction causes the engagement latch 64 to pivot about pin 66, for example until a portion of the latch 64 contacts the bumper 68. Rotation of the engagement latch 64 about the pivot pin 66 separates the engagement hook 70 from the electrical switch 72, thereby generating a signal that the elevator car doors 26 are unlocked. In this position, the car doors 26 and landing doors 28 are coupled and are able to translate to a fully open position.

To close the elevator car doors 26, the door operator 30 actuates the drive mechanism 32 in a second, opposite direction, causing the link arm 58 to pivot about pin 60 and the engagement latch 64 to rotate about pin 66 such that the engagement hook 70 rotates into contact with the electrical switch 72. The rotation of the link arm 58 additionally rotates the roller 62 away from the sensing vane 52, thereby allowing the sensing vane to return to its original position.

Figure 12:
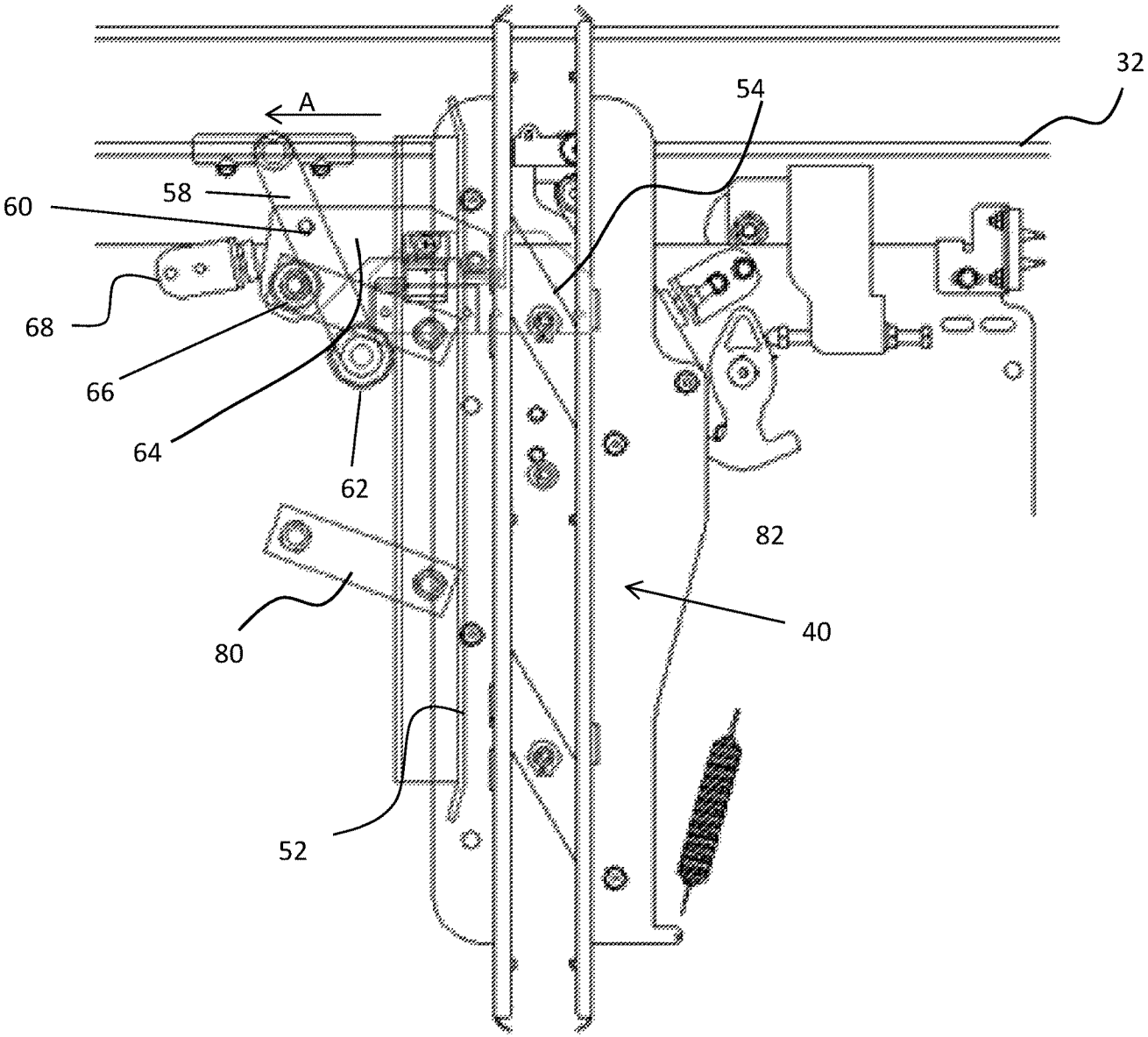
FIG. 12 is a detailed view of the car door interlock of FIG. 9 when the door operator is energized when the elevator is outside a landing door zone according to an embodiment.

Referring now to FIG. 12, if the door operator 30 actuates the drive mechanism 32 when the elevator car 20 is not within a landing door zone, the elevator car doors 26 will not open. In the absence of the interlock roller 82, operation of the door operator 30 causes the sensing vane 52 to move freely between the first and second positions. Without the contact between the interlock roller 82 and the sensing vane 52, the link arm 58 rotates freely relative to the engagement latch 64. The engagement latch 64 does not rotate about pivot 66. As a result, the engagement hook 70 remains in contact with the electrical switch 72 and the car doors 26 remain locked.

The car door interlocks 50 described herein are configured to operate independently from the door coupler 40. Accordingly the car door interlock 50 may be used in both new elevator systems and retrofit applications.

While the disclosure has been described in detail in connection with only a limited number of embodiments, it should be readily understood that the disclosure is not limited to such disclosed embodiments. Rather, embodiments can be modified to incorporate any number of variations, alterations, substitutions, or equivalent arrangements not heretofore described hut which are commensurate with the spirit and scope of the disclosure, Additionally, while various embodiments have been described, it is to be understood that aspects of the disclosure may include only some of the described embodiments. Accordingly, the disclosure is not to be seen as limited by the foregoing description, but is only limited by the scope of the appended claims.

What is claimed is:

1. A method of unlocking an elevator car door or an elevator car, comprising:

operating a door operator;

rotating a link arm of a car door interlock operably coupled to the door operator about a first axis such that a sensing mechanism coupled to the link arm is moved into contact with a movable vane; and moving the movable vane operably coupled to the door operator via the sensing mechanism, wherein if the elevator car is positioned within a landing door zone during the rotating of the link arm, the movable vane is moved into contact with an interlock roller and an engagement latch is pivoted about a second axis to disengage from an electrical contact in response to moving the movable vane into contact with the interlock roller.

2. The method of claim 1, further comprising further operating the door operator after the movable vane is moved into contact with the interlock roller, wherein rotating the engagement latch to disengage from the electrical contact occurs in response to the further operating the door operator.

3. The method of claim 1, wherein if the elevator car is not positioned within the landing door zone, the movable vane does not contact the interlock roller and the engagement latch remains in engaged with the electrical contact.

4. The method according to claim 1, wherein the engagement latch is pivotally mounted to the link arm and the engagement latch is only configured to rotate out of engagement with the electrical contact when further rotation of the link arm is restricted.

5. The method according to claim 4, wherein further rotation of the link arm is restricted when the movable vane is in contact with the interlock roller.

6. The method according to claim 4, wherein moving the movable vane is driven by the link arm.

7. The method of claim 4, wherein rotation of the engagement latch relative to the link arm is limited by a bumper.

8. The method of claim 1, wherein the sensing mechanism is a roller.

9. The method of claim 1, wherein the movable vane is mounted to the elevator car.

* * * * *